US006981935B2

(12) United States Patent
Gustafson

(10) Patent No.: US 6,981,935 B2
(45) Date of Patent: Jan. 3, 2006

(54) SUCTION ROLL WITH SENSORS FOR DETECTING TEMPERATURE AND/OR PRESSURE

(75) Inventor: Eric J. Gustafson, Stephens City, VA (US)

(73) Assignee: Stowe Woodward, L.L.C., Middletown, VA (US)

( * ) Notice: Subject to any disclaimer, the term of this patent is extended or adjusted under 35 U.S.C. 154(b) by 0 days.

(21) Appl. No.: 10/241,915

(22) Filed: Sep. 12, 2002

(65) Prior Publication Data

US 2004/0053758 A1 Mar. 18, 2004

(51) Int. Cl.
*B05C 1/08* (2006.01)
*B30B 15/00* (2006.01)

(52) U.S. Cl. ..... 492/10; 492/11; 492/30; 100/99

(58) Field of Classification Search ..... 492/9, 492/10, 11, 20, 28, 30, 48, 59; 162/358, 162/372; 100/35, 50, 99, 100, 176, 153, 100/162 B; 73/862.55
See application file for complete search history.

(56) References Cited

U.S. PATENT DOCUMENTS

| | | | | |
|---|---|---|---|---|
| 3,562,883 | A | 2/1971 | Kobayashi | |
| 3,962,911 | A | 6/1976 | Grenlund | |
| 4,016,756 | A | 4/1977 | Kunkle | |
| 4,233,011 | A | 11/1980 | Bolender et al. | |
| 4,366,025 | A | 12/1982 | Gordon, Jr. et al. | |
| 4,509,237 | A | 4/1985 | Volz et al. | |
| 4,729,153 | A | 3/1988 | Pav et al. | |
| 4,871,908 | A | 10/1989 | Skuratovsky et al. | |
| 4,898,012 | A | 2/1990 | Jones et al. | |
| 4,910,985 | A | 3/1990 | Ballyns | |
| 4,938,045 | A | 7/1990 | Rosenstock et al. | |
| 5,048,353 | A * | 9/1991 | Justus et al. | 73/862.55 |
| 5,379,652 | A | 1/1995 | Allonen | |
| 5,383,371 | A | 1/1995 | Laitinen | |
| 5,466,343 | A | 11/1995 | Kankaanpaa | |
| 5,562,027 | A | 10/1996 | Moore | |
| 5,684,912 | A | 11/1997 | Slaney et al. | |
| 5,915,648 | A | 6/1999 | Madrzak et al. | |
| 5,925,220 | A | 7/1999 | Hirsch et al. | |
| 6,284,103 | B1 | 9/2001 | Eng et al. | |
| 6,361,483 | B1 * | 3/2002 | Kirchner | 492/16 |

(Continued)

FOREIGN PATENT DOCUMENTS

DE 199 20 133 11/2000

(Continued)

OTHER PUBLICATIONS

PCT International Search Report PCT/US03/18895.

(Continued)

*Primary Examiner*—Marc Jimenez
(74) *Attorney, Agent, or Firm*—Myers Bigel Sibley & Sajovec

(57) ABSTRACT

An industrial roll includes: a substantially cylindrical shell having an outer surface and an internal lumen; a polymeric cover circumferentially overlying the shell outer surface; and a sensing system. The sensing system includes: a plurality of sensors embedded in the cover, the sensors configured to sense an operating parameter of the roll; and a signal-carrying member serially connected with and extending between the plurality of sensors. The signal-carrying member follows a helical path over the outer surface of the shell, wherein the signal-carrying member extends between adjacent sensors and extends over more than one complete revolution of the shell outer surface (and, preferably, an intermediate segment of the signal-carrying member extends over more than a full revolution of the roll between adjacent sensors).

22 Claims, 5 Drawing Sheets

U.S. PATENT DOCUMENTS 6,752,908 B2 * 6/2004 Gustafson et al. ..... 162/358.3

FOREIGN PATENT DOCUMENTS

| | | |
|---|---|---|
| FR | 2 769 379 | 4/1999 |
| WO | WO 96/34262 | 10/1996 |
| WO | WO 01/53787 | 7/2001 |

OTHER PUBLICATIONS

Knowles, S.F. et al; "*Multiple microbending optical-fibre sensors for measurement of fuel quantity in aircraft fuel tanks*;" vol. 68, No. 1-3 (Jun. 15, 1998) pps. 320-323. XP004139852.

Anonymous: "*Les Capteurs a Fibres Optiques Operationnels*?" vol. 51, No. 13 (Oct. 20, 1986) pps 49-51, 53, 55 XP002083807.

McCollum, T et al; "*Fiber optic microbend sensor for detection of dynamic fluid pressure at gear interfaces*." vol. 65, No. 3, (Mar. 1, 1994) pp 724-729 XP000435198.

International Search Report for PCT/US01/02013.

* cited by examiner

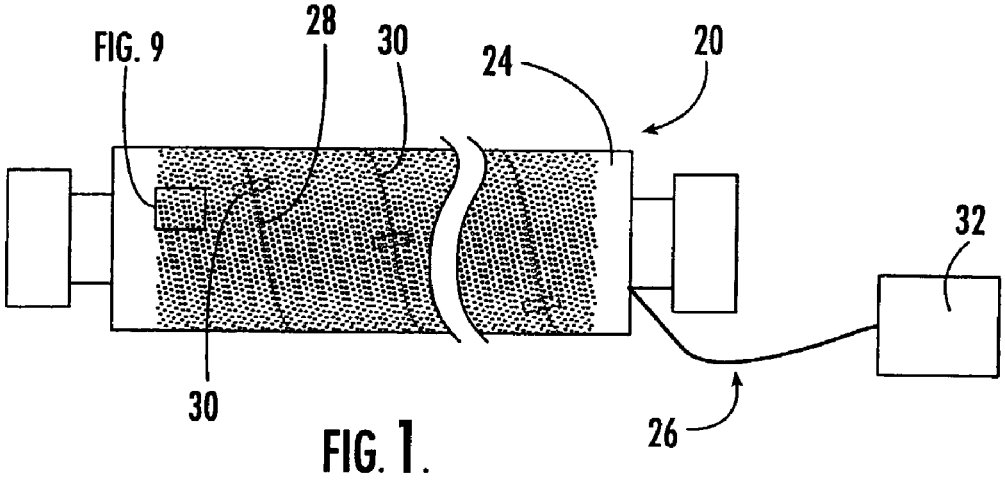
FIG. 1.
FIG. 2.
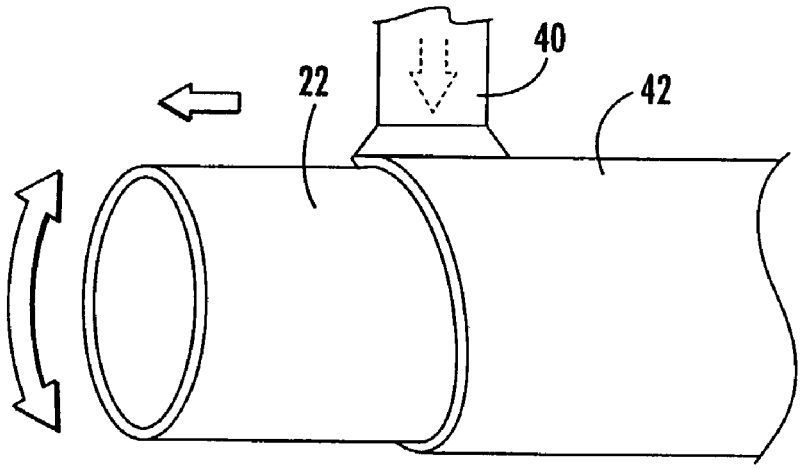

SUCTION ROLL WITH SENSORS FOR DETECTING TEMPERATURE AND/OR PRESSURE

FIELD OF THE INVENTION

The present invention relates generally to industrial rolls, and more particularly to rolls for papermaking.

BACKGROUND OF THE INVENTION

Cylindrical rolls are utilized in a number of industrial applications, especially those relating to papermaking. Such rolls are typically employed in demanding environments in which they can be exposed to high dynamic loads and temperatures and aggressive or corrosive chemical agents. As an example, in a typical paper mill, rolls are used not only for transporting a fibrous web sheet between processing stations, but also, in the case of press section and calender rolls, for processing the web sheet itself into paper.

A papermaking machine may include one or more suction rolls placed at various positions within the machine to draw moisture from a belt (such as a press felt) and/or the fiber web. Each suction roll is typically constructed from a metallic shell covered by a polymeric cover with a plurality of holes extending radially therethrough. Vacuum pressure is applied with a suction box located in the interior of the suction roll shell. Water is drawn into the radially-extending holes and is either propelled centrifugally from the holes after they pass out of the suction zone or transported from the interior of the suction roll shell through appropriate fluid conduits or piping. The holes are typically formed in a grid-like pattern by a multi-bit drill that forms a line of multiple holes at once (for example, the drill may form fifty aligned holes at once). In many grid patterns, the holes are arranged such that rows and columns of holes are at an oblique angle to the longitudinal axis of the roll.

As the paper web is conveyed through a papermaking machine, it can be very important to understand the pressure profile experienced by the paper web. Variations in pressure can impact the amount of water drained from the web, which can affect the ultimate sheet moisture content, thickness, and other properties. The magnitude of pressure applied with a suction roll can, therefore, impact the quality of paper produced with the paper machine.

Other properties of a suction roll can also be important. For example, the stress and strain experienced by the roll cover in the cross machine direction can provide information about the durability and dimensional stability of the cover. In addition, the temperature profile of the roll can assist in identifying potential problem areas of the cover.

It is known to include pressure and/or temperature sensors in the cover of an industrial roll. For example, U.S. Pat. No. 5,699,729 to Moschel et al. describes a roll with a helically-disposed fiber that includes a plurality of pressure sensors embedded in the polymeric cover of the roll. However, a suction roll of the type described above presents technical challenges that a conventional roll does not. For example, suction roll hole patterns are ordinarily designed with sufficient density that some of the holes would overlie portions of the sensors. Conventionally, the sensors and accompanying fiber are applied to the metallic shell prior to the application of the polymeric cover, and the suction holes are drilled after the application and curing of the cover. Thus, drilling holes in the cover in a conventional manner would almost certainly damage the sensors, and may well damage the optical fiber. Also, during curing of the cover often the polymeric material shifts slightly on the core, and in turn may shift the positions of the fiber and sensors; thus, it is not always possible to determine precisely the position of the fiber and sensors beneath the cover, and the shifting core may move a sensor or cable to a position directly beneath a hole. Further, ordinarily optical cable has a relative high minimum bending radius for suitable performance; thus, trying to weave an optical fiber between prospective holes in the roll may result in unacceptable optical transmission within the fiber.

SUMMARY OF THE INVENTION

The present invention is directed to sensing systems for industrial rolls that can be employed with suction rolls. As a first aspect, the present invention is directed to an industrial roll comprising: a substantially cylindrical shell having an outer surface and an internal lumen; a polymeric cover circumferentially overlying the shell outer surface; and a sensing system. The sensing system includes: a plurality of sensors embedded in the cover, the sensors configured to sense an operating parameter of the roll; and a signal-carrying member serially connected with and extending between the plurality of sensors. The signal-carrying member follows a helical path over the outer surface of the shell, wherein the signal-carrying member extends between adjacent sensors extends over more than one complete revolution of the shell outer surface (and, preferably, an intermediate segment of the signal-carrying member extends over more than a full revolution of the roll between adjacent sensors).

As a second aspect, the present invention is directed to an industrial roll comprising: a substantially cylindrical shell having an outer surface and an internal lumen; a polymeric cover circumferentially overlying the shell outer surface, the cover including an internal groove that defines a helical path; and a sensing system, wherein the sensing system includes a plurality of sensors embedded in the cover that are configured to sense an operating parameter of the roll and a signal-carrying member serially connected with and extending between the plurality of sensors. The signal-carrying member resides in the groove and follows the helical path in the shell outer surface.

As a third aspect, the present invention is directed to an industrial roll, comprising: a substantially cylindrical shell having an outer surface and an internal lumen; a polymeric cover circumferentially overlying the shell outer surface; and a sensing system including a plurality of sensors embedded in the cover, the sensors configured to sense an operating parameter of the roll; and a signal-carrying member serially connected with and extending between the plurality of sensors. At least one of the plurality of sensors is configured to slide along and relative to the signal-carrying member.

As a fourth aspect, the present invention is directed to an industrial roll, comprising: a substantially cylindrical shell having an outer surface and an internal lumen; a polymeric cover circumferentially overlying the shell outer surface, wherein the cover and shell include a plurality of through holes extending from an outer surface of the cover to the shell lumen, such that the lumen is in fluid communication with the environmental external to the cover outer surface; and a sensing system comprising: a plurality of sensors embedded in the cover, the sensors configured to sense an operating parameter of the roll; and a signal-carrying member serially connected with and extending between the plurality of sensors, the signal-carrying member following a helical path over the outer surface of the shell. The cover further comprises at least one blind drilled hole located over one of the plurality of sensors.

As a fifth aspect, the present invention is directed to a method of calculating the axial and circumferential positions of sensors on an industrial suction roll. The method comprises the steps of: providing as input variables (a) one of the diameter and circumference of the roll and (b) an angle defined by a hole pattern in the industrial roll and a plane perpendicular to the longitudinal axis of the roll; selecting a value for one of an axial or circumferential position of a sensor; and determining the other of the axial or circumferential position of the sensor based on the values of the diameter or circumference of the roll, hole pattern angle and axial or circumferential position.

Each of these aspects of the invention (as well as others) can facilitate the employment of a sensing system within a suction roll cover, thereby overcoming some of the difficulties presented by prior sensing systems.

BRIEF DESCRIPTION OF THE FIGURES

FIG. 1 is a gage view of a suction roll and detecting system of the present invention.

FIG. 2 is a gage perspective view of a shell and cover base layer formed in the manufacture of the suction roll of FIG. 1.

DETAILED DESCRIPTION OF THE INVENTION

Figure 3:
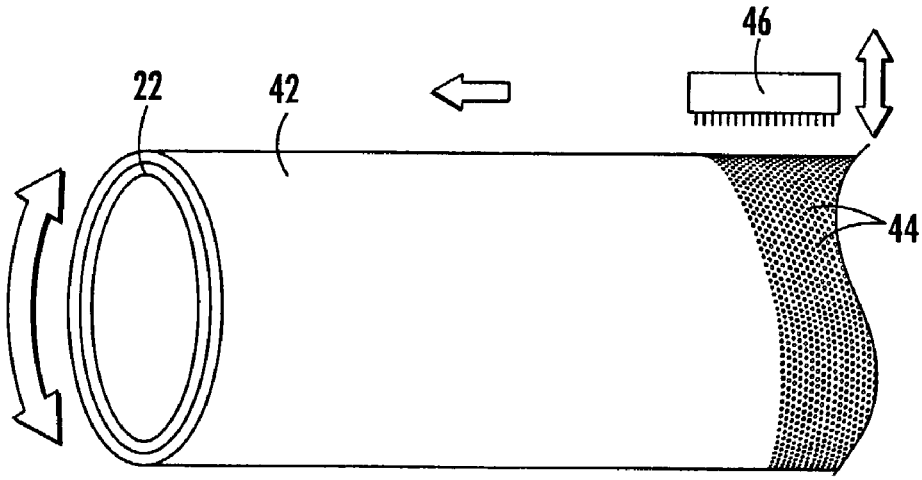
FIG. 3 is a gage perspective view of shell and cover base layer of FIG. 2 being scored with a drill.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the figures, a suction roll, designated broadly at 20, is illustrated in FIG. 1. The suction roll 20 includes a hollow cylindrical shell or core 22 (see FIG. 2) and a cover 24 (typically formed of one or more polymeric materials) that encircles the shell 22. A sensing system 26 for sensing pressure, temperature, or some other operational parameter of interest includes a helical optical fiber 28 and a plurality of sensors 30, each of which is embedded in the cover 24. The sensing system 26 also includes a processor 32 that processes signals produced by the sensors 30.

The shell 22 is typically formed of a corrosion-resistant metallic material, such as stainless steel or bronze. A suction box (not shown) is typically positioned within the lumen of the shell 22 to apply negative pressure (i.e., suction) through holes in the shell 22 and cover 24. Typically, the shell 22 will already include through holes that will later align with through holes 82 and blind-drilled holes 84. An exemplary shell and suction box combination is illustrated and described in U.S. Pat. No. 6,358,370 to Huttunen, the disclosure of which is hereby incorporated herein in its entirety.

Figure 7:
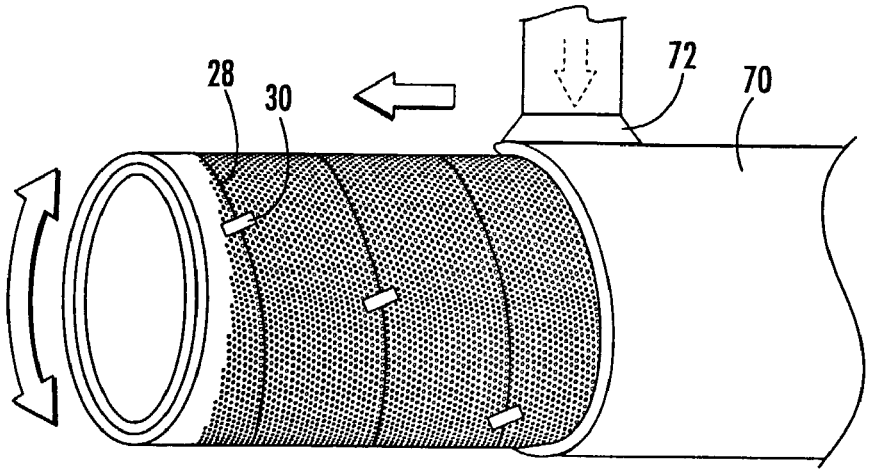
FIG. 7 is a gage perspective view of the topstock layer being applied over the cover base layer, optical fiber and sensors of FIGS. 3 and 5.

The cover 24 can take any form and can be formed of any polymeric and/or elastomeric material recognized by those skilled in this art to be suitable for use with a suction roll. Exemplary materials include natural rubber, synthetic rubbers such as neoprene, styrene-butadiene (SBR), nitrile rubber, chlorosulfonated polyethylene ("CSPE"—also known under the trade name HYPALON), EDPM (the name given to an ethylene-propylene terpolymer formed of ethylene-propylene diene monomer), epoxy, and polyurethane. In many instances, the cover 24 will comprise multiple layers (FIGS. 2 and 7 illustrate the application of separate base and topstock layers 42, 70; additional layers, such as a "tie-in" layer between the base and topstock layers 42, 70 and an adhesive layer between the shell 22 and the base layer 42, may also be included). The cover 24 may also include reinforcing and filler materials, additives, and the like. Exemplary additional materials are discussed in U.S. Pat. No. 6,328,681 to Stephens and U.S. Pat. No. 6,375,602 to Jones, the disclosures of which are hereby incorporated herein in their entireties.

Figure 9:
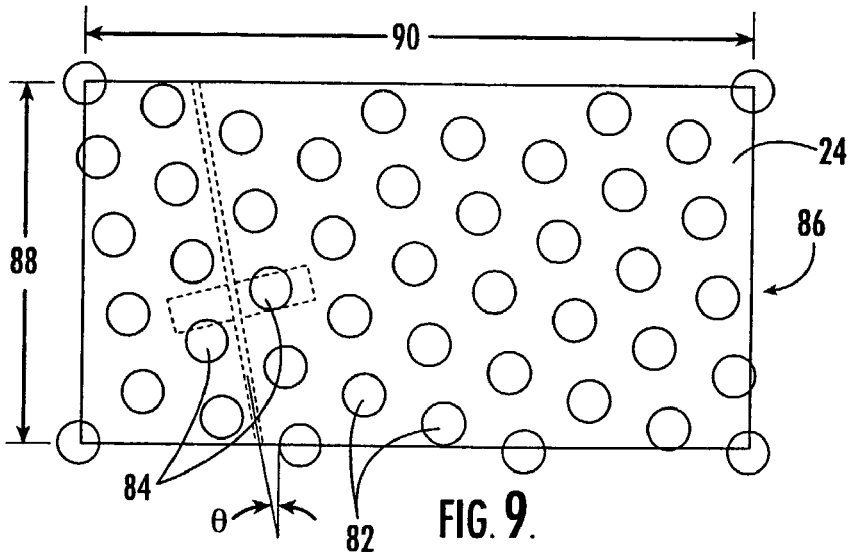
FIG. 9 is an enlarged top view of a typical hole pattern for a suction roll of FIG. 1.

The cover 24 has a pattern of holes (which includes through holes 82 and blind drilled holes 84) that may be any of the hole patterns conventionally employed with suction rolls or recognized to be suitable for applying suction to an overlying papermaker's felt or fabric and/or a paper web as it travels over the roll 20. A base repeat unit 86 of one exemplary hole pattern is illustrated in FIG. 9. The repeat unit 86 can be defined by a frame 88 that represents the height or circumferential expanse of the pattern (this dimension is typically about 0.5 to 1.5 inches) and a drill spacing 90 that represents the width or axial expanse of the pattern. As is typical, the columns of holes 82, 84 define an angle $\theta$ (typically between about 5 and 20 degrees) relative to a plane that is perpendicular to the longitudinal axis of the roll 20.

Referring back to FIG. 1, the optical fiber 28 of the sensing system 26 can be any optical fiber recognized by those skilled in this art as being suitable for the passage of optical signals in a suction roll. Alternatively, another signal-carrying member, such as an electrical cable, may be employed. The sensors 30 can take any form recognized by those skilled in this art as being suitable for detecting the operational parameter of interest (e.g., stress, strain, pressure or temperature). It is preferred, as described below, that the sensors 30 be of a configuration that permits them to slide (at least for a short distance) along the optical fiber 28. Exemplary fibers and sensors are discussed in U.S. Pat. No. 5,699,729 to Moschel et al. and U.S. patent application Ser. No. 09/489,768, the contents of each of which are hereby incorporated herein by reference in their entireties.

The processor 32 is typically a personal computer or similar data exchange device, such as the distributive control system of a paper mill, that can process signals from the sensors 30 into useful, easily understood information. It is preferred that a wireless communication mode, such as RF signaling, be used to transmit the data from the sensors 30 to the processing unit 32. Other alternative configurations include slip ring connectors that enable the signals to be transmitted from the sensors 30 to the processor 32. Suitable exemplary processing units are discussed in U.S. Pat. No. 5,562,027 to Moore and U.S. patent application Ser. No. 09/872,584, the disclosures of which are hereby incorporated herein in their entireties.

The suction roll 20 can be manufactured in the manner described below and illustrated in FIGS. 2–9. In this method, initially the shell 22 is covered with a portion of the cover 24 (such as the base layer 42). As can be seen in FIG. 2, the base layer 42 can be applied with an extrusion nozzle 40, although the base layer 42 may be applied by other techniques known to those skilled in this art. It will also be understood by those skilled in this art that, although the steps described below and illustrated in FIGS. 3–6 are shown to be performed on a base layer 42, other internal layers of a cover 24 (such as a tie-in layer) may also serve as the underlying surface for the optical fiber 28 and sensors 30.

Referring now to FIG. 3, the base layer 42 of the cover 24 is scored or otherwise marked, for example with a multi-bit drill 46, with score marks 44 that correspond to a desired pattern of holes 82, 84 that will ultimately be formed in the roll 20. The score marks 46 should be of sufficient depth to be visible in order to indicate the locations where holes will ultimately be formed, but need not be any deeper.

Figure 4:
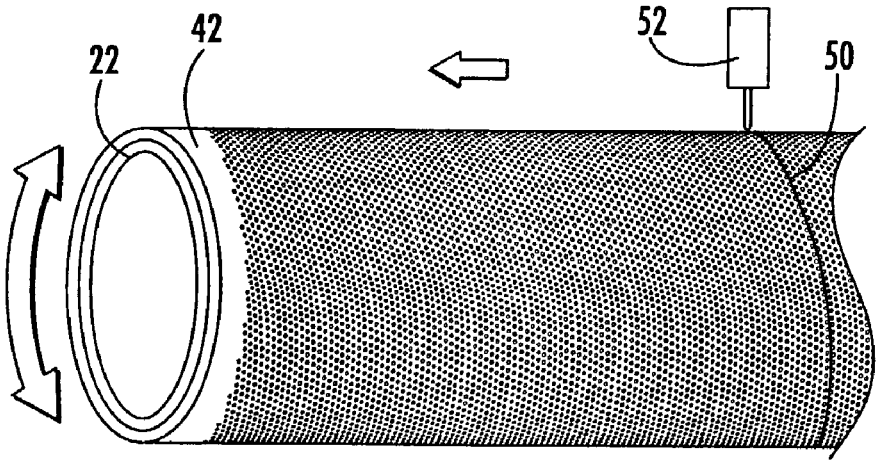
FIG. 4 is a gage perspective view of a groove being formed with a lathe in cover base layer of FIG. 3.

Turning now to FIG. 4, a continuous helical groove 50 is cut into the base layer 42 with a cutting device, such as the lathe 52 illustrated herein. The groove 50 is formed between the score marks 44 at a depth of about 0.010 inches (it should be deep enough to retain the optical fiber 28 therein), and should make more than one full revolution of the outer surface of the base layer 42. In some embodiments, the groove 50 will be formed at the angle θ defined by the holes 82, 84 and will be positioned between the columns of holes. In most embodiments, the angle θ is such that the groove 50 encircles the base layer 42 multiple times; for example, for a roll that has a length of 240 inches, a diameter of 36 inches, and an angle θ of 10 degrees, the groove 50 encircles the roll twelve times from end to end.

Figure 5:
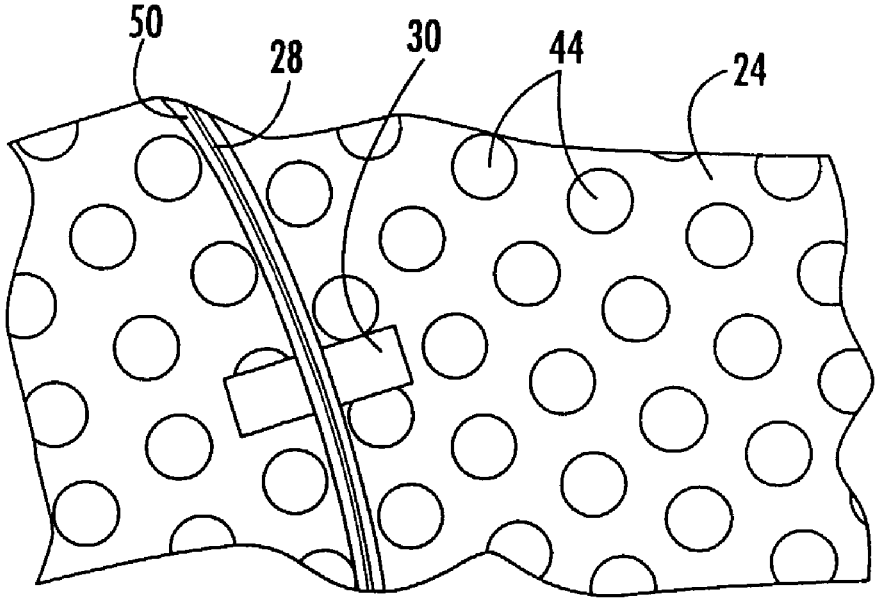
FIG. 5 is an enlarged partial gage perspective view of an optical fiber and sensor positioned in the groove formed in the cover base layer as shown in FIG. 4.

Referring now to FIG. 5, after the groove 50 is formed in the base layer 42, the optical fiber 28 and sensors 30 of the sensor system 26 are installed. The optical fiber 28 is helically wound within the groove 50, with the sensors 30 being positioned closely adjacent to desired locations. The fiber 28 is retained within the groove 50 and is thereby prevented from side-to-side movement.

Figure 6:
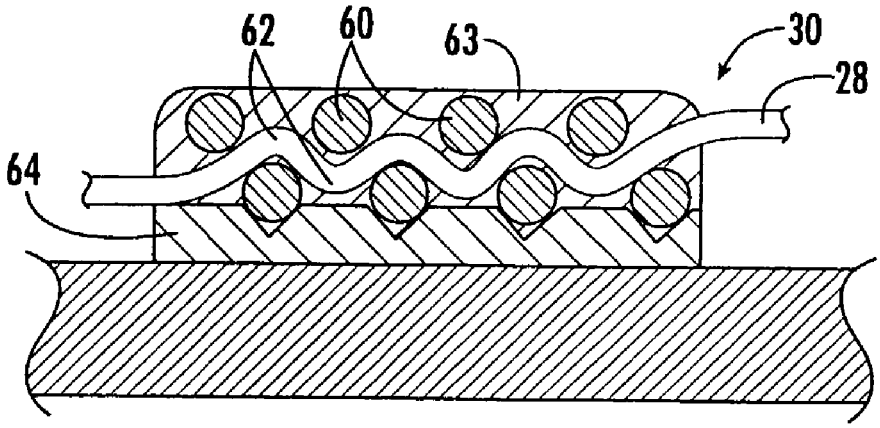
FIG. 6 is a greatly enlarged side section view of a sensor and optical fiber of FIG. 5.

It may be desirable to shift the positions of the sensors 30 slightly to precise locations on the base layer 42. Because the optical fiber 28 is retained within the groove 50 and its relative inflexibility (i.e., it may break at a relatively high bending radius) may prevent bending a portion of the fiber 28 out of the groove in order to position a sensor 30, in some embodiments the sensor 30 may be free to slide short distances along the fiber 28. One exemplary design is illustrated in FIG. 6. As can be see therein, the sensor 30 includes a plurality of bending elements 60 (typically formed of glass or nylon) that are positioned in a staggered relationship. The fiber 28 threads between the bending elements 60 to form a series of merging undulations 62. In this regard the sensor 30 resembles sensors described in U.S. patent application Ser. No. 09/489,768 identified above. That sensor is typically constructed with an epoxy or other filling material 63 that fills the gaps between the bending elements 60 and the undulations 62 and maintains the positional relationship between them (i.e., it maintains the undulations 62 in alignment with the bending elements 60 and holds the bending elements 60 in line with one another). In the sensor 30 of the present invention, it is preferred that an epoxy or other material be used to fill the volume between the bending elements 60 and the undulations 62, but that such filling material not bond to the undulations 62, thereby enabling the bending elements 60 (which are typically attached to a common substrate 64) to slide along the fiber 62. This may be carried out, for example, by selecting a filling material (such as an epoxy) that does not chemically bond to the fiber 28, or by coating the fiber 28 with a coating (such as a mold release) that prevents the filling material 63 from bonding to the fiber 28. Such a slidable configuration would enable the positioning of the sensor 30 to be adjusted slightly relative to the fiber 28 to a desired precise position while not overstressing the fiber 28 through undue bending.

Once the sensors 30 are in desired positions, they can be adhered in place. This may be carried out by any technique known to those skilled in this art; an exemplary technique is adhesive bonding.

Referring now to FIG. 7, once the sensors 30 and fiber 28 have been positioned and affixed to the base layer 42, the remainder of the cover 24 is applied. FIG. 7 illustrates the application of a top stock layer 70 with an extrusion nozzle 72. Those skilled in this art will appreciate that the application of the top stock layer 72 can be carried out by any technique recognized as being suitable for such application. As noted above, the present invention is intended to include rolls having covers that include only a base layer and top stock layer as well as rolls having covers with additional intermediate layers. Application of the top stock layer 70 is followed by curing, techniques for which are well-known to those skilled in this art and need not be described in detail herein.

Figure 8:
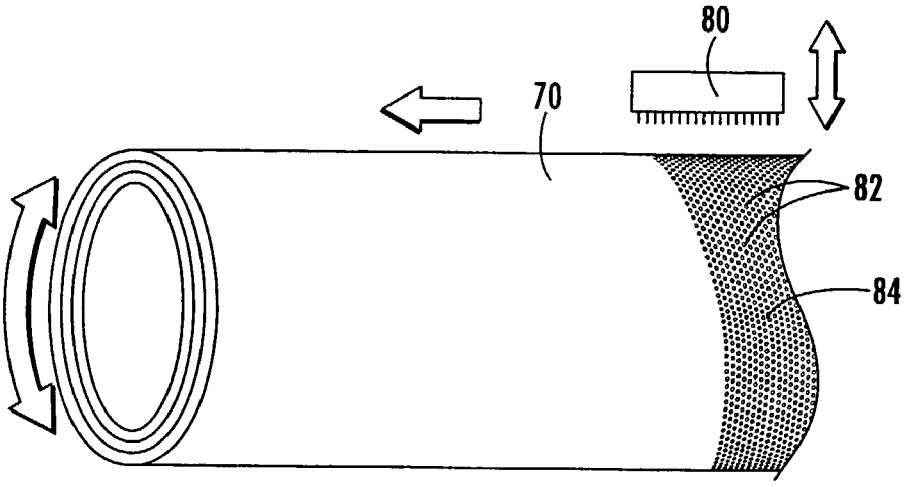
FIG. 8 is a gage perspective view of the topstock layer of FIG. 7 and shell and cover base layer of FIG. 3 being drilled with a drill.

Referring now to FIG. 8, after the top stock layer 70 is cured, the through holes 82 and the blind drilled holes 84 are formed in the cover 24 and, in the event that through holes 82 have not already been formed in the shell 22, are also formed therein. The through holes 82 can be formed by any technique known to those skilled in this art, but are preferably formed with a multi-bit drill 80 (an exemplary drill is the DRILLMATIC machine, available from Safop, Pordenone, Italy). Care should be taken not to drill through holes 82 over the locations of sensors 30; instead, blind-drilled holes 84 can be drilled in these locations.

Because the hole pattern may define the path that the optical fiber 28 (and, in turn, the groove 50) can follow, in some rolls conventional placement of the sensors 30 (i.e., evenly spaced axially and circumferentially, and in a single helix) may not be possible. As such, one must determine which axial and circumferential positions are available for a particular roll. Variables that can impact the positioning of sensors include the size of the roll (the length, diameter and/or circumference) and the angle θ defined by the hole pattern. Specifically, the relationships between these variables can be described in the manner discussed below.

Figure 10:
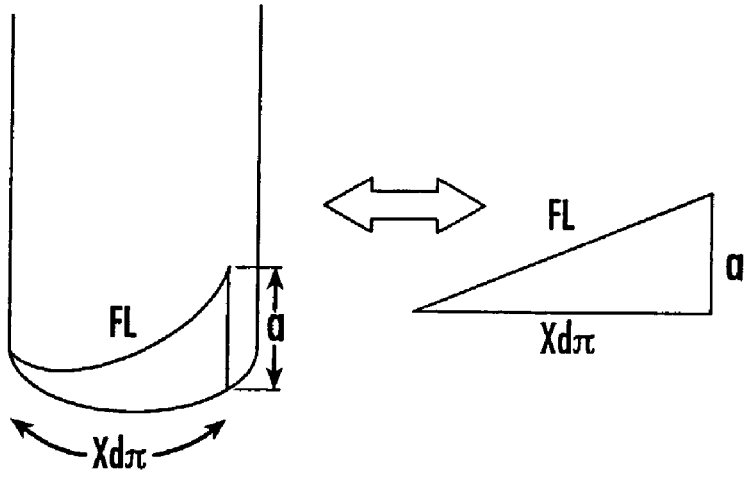
FIG. 10 is a schematic diagram exhibiting the derivation of formulae employed in some embodiments of methods of determining axial and circumferential positions of sensors according to the present invention.

The length of the fiber extending from an origin point on the roll to a particular axial and circumferential position can be modeled as the hypotenuse of a right triangle, in which the axial position serves as the height of the triangle and the total circumferential distance covered by the fiber serves as the base of the triangle (see FIG. 10). This relationship can be described as:

$$\sin\theta = a/FL; \text{ and} \qquad \text{Equation 1}$$

$$\cos\theta = Xd\pi/FL \qquad \text{Equation 2}$$

wherein:

FL=fiber length from origin to sensor position;

a=axial distance from origin to sensor position;

d=diameter of the roll;

X=number of revolutions of fiber around the circumference of the roll; and

θ=angle defined by suction hole pattern relative to plane through axis of roll.

Solving equations 1 and 2 for FL, then substituting yields:

$$Xd\pi/\cos\theta = a/\sin\theta \qquad \text{Equation 3}$$

Because (sin θ/cos θ) can be simplified to tan θ, the expression can be reduced to $$a = Xd\pi(\tan\theta) \qquad \text{Equation 4}$$

Thus, for any axial position a, the corresponding circumferential position (expressed in the number revolutions, which can be converted into degrees by multiplying by 360) can be calculated; the reverse can be performed to calculate the axial position from a given circumferential position.

An alternative method for calculating the axial and circumferential positions employing some practical measurements used in suction rolls can also be used. For a specific roll with a designated hole pattern, the following variables can be assigned:

α=angular position on the roll;

z=axial position on the roll;

d=drill spacing;

N=number of frames in the circumference of a roll (this is a whole number); and

B=number of frames required for a diagonal row of holes to move in the axial direction the distance of one drill spacing.

For an optical fiber 28 that follows the drill pattern on a drilled roll, $$\alpha = (B/N)(z/d) \qquad \text{Equation 5}$$

with α being given in revolutions (again, multiplying α by 360 degrees gives the angular position in degrees). Thus, for a given drilled roll defined by a diameter, a length and a hole pattern, B, N and d are known. The circumferential position can then be calculated for a given axial position; alternatively, the axial position can be calculated for a given circumferential position.

Those skilled in this art will recognize that the aforementioned methods of calculating axial position and circumferential position may be performed using different forms of variables as demonstrated, and that other forms may also be used that consider the diameter and/or circumference of the roll and the angle at which the fiber travels in its helix.

Figure 11:
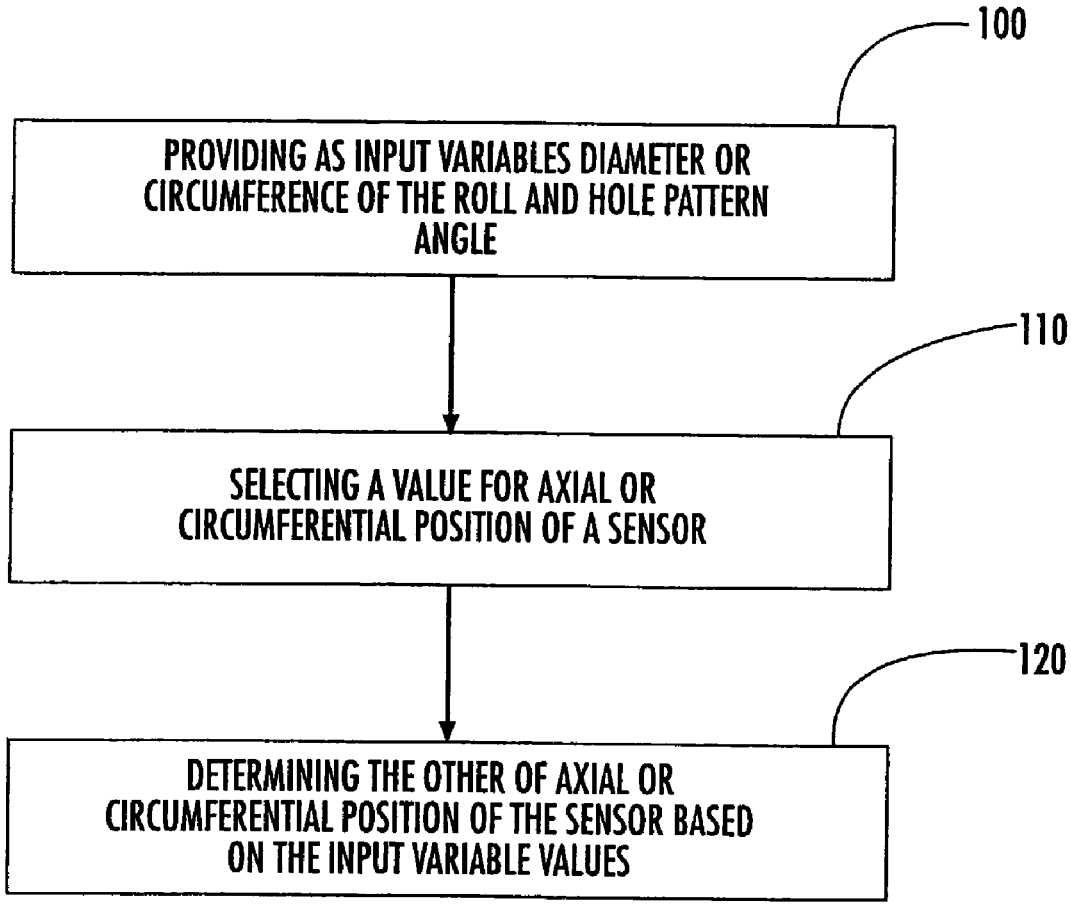
FIG. 11 is a flow chart illustrating steps in determining axial and circumferential positions of sensors according to methods of the present invention.

In some embodiments, the calculation can be performed with a computer program designed and configured to receive data input of the type described above and, using such data, calculate axial and circumferential positions for sensors. Such a program is exemplified in FIG. 11. As an initial step, input variables regarding the configuration of the roll (typically one of diameter or circumference of the roll) and the angle of the hole pattern (typically either the angle itself or a similar property, such as the drill spacing and the numbers of frames required to complete a circumference and to move the pattern one full drill spacing) are provided. Next, one of a circumferential position or an axial position is selected. The computer program can then determine the other of the circumferential or axial position of the sensor. This information can be used to determine whether the combination of axial and circumferential positions is suitable for use with the roll.

Inasmuch as the present invention may be embodied as methods, data processing systems, and/or computer program products, the present invention may take the form of an entirely hardware embodiment, an entirely software embodiment or an embodiment combining software and hardware aspects. Furthermore, the present invention may take the form of a computer program product on a computer-usable storage medium having computer-usable program code embodied in the medium. Any suitable computer readable medium may be utilized including, but not limited to, hard disks, CD-ROMs, optical storage devices, and magnetic storage devices.

Computer program code for carrying out operations of the present invention may be written in an object oriented programming language such as JAVA®, Smalltalk or C++. The computer program code for carrying out operations of the present invention may also be written in conventional procedural programming languages, such as "C", or in various other programming languages. Software embodiments of the present invention do not depend on implementation with a particular programming language. In addition, portions of computer program code may execute entirely on one or more data processing systems.

The present invention is described above with reference to block diagram and/or flowchart illustrations of methods, apparatus (systems) and computer program products according to embodiments of the invention. It is understood that each block of the block diagram and/or flowchart illustrations, and combinations of blocks in the block diagram and/or flowchart illustrations, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions specified in the block diagram and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the block diagram and/or flowchart block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the block diagram and/or flowchart block or blocks.

It should be noted that, in some alternative embodiments of the present invention, the functions noted in the blocks may occur out of the order noted in the figures. For example, two blocks shown in succession may in fact be executed substantially concurrently or the blocks may sometimes be executed in the reverse order, depending on the functionality involved. Furthermore, in certain embodiments of the present invention, such as object oriented programming embodiments, the sequential nature of the flowcharts may be replaced with an object model such that operations and/or functions may be performed in parallel or sequentially.

The use of the equations set forth above can be demonstrated with the following examples.

EXAMPLE

In this example, it is assumed that the roll has the dimensions set forth in Table 1, and that the hole pattern is that illustrated in FIG. 9.

| Dimension | Quantity |
|---|---|
| Diameter | 36 inches |
| Axial Length of Roll between Outermost Sensors | 238 inches |
| Frame | 0.725 inches |
| Drill Spacing | 1.405 inches |

The diameter and frame measurements indicate that the variable N above is 156, and for the hole pattern of FIG. 9, the variable B is 9. Thus, for this roll, Equation 5 yields:

$$\alpha=0.041z \qquad \text{Equation 6}$$

This equation can then be used to calculate axial and circumferential coordinates for sensors.

If the circumferential spacing is maintained to be the same as a typical roll (usually 21 sensors over a 360 degree circumference, or about 17.14 degrees between sensors), a set of circumferential and axial positions can be calculated (Table 2).

| Sensor No. | Total Angle (degrees) | Simple Angle (degrees) | Axial Position (inches) |
|---|---|---|---|
| 1 | 0.000 | 0.000 | 0.0 |
| 2 | 377.143 | 17.143 | 25.55 |
| 3 | 754.286 | 34.286 | 51.10 |
| 4 | 1131.429 | 51.429 | 76.65 |
| 5 | 1508.572 | 68.572 | 101.70 |
| 6 | 1885.714 | 85.714 | 127.25 |
| 7 | 2262.857 | 102.857 | 152.80 |
| 8 | 2640.000 | 120.000 | 178.35 |
| 9 | 3017.144 | 137.144 | 203.90 |
| 10 | 3394.286 | 154.286 | 229.45 |

It can be seen from the "Total Angle" calculation that, for each subsequent axial position, the angle increases by a full revolution of the roll. This corresponds to a full loop of the optical fiber 28 around the roll between adjacent sensors 30. It can also be seen that, for this embodiment, the sensors 30 would be positioned over less than a full circumference of the roll 20 (only about 154 degrees), so some portions of the circumferential surface of the roll 20 would not have sensors 30 below them. In addition, there are fewer sensors 30 (ten, as opposed to the more typical 21) spaced relatively evenly along the length of the roll 20.

If, rather than the circumferential spacing of a conventional roll being maintained, the conventional axial spacing of 11.9 inches is maintained, Equation 2 gives the circumferential positions shown in Table 3.

| Sensor | Total Angle (degrees) | Simple Angle (degrees) | Axial Position (inches) |
|---|---|---|---|
| 1 | 0.0 | 0.0 | 0.0 |
| 2 | 175.785 | 175.785 | 11.9 |
| 3 | 351.570 | 351.570 | 23.8 |
| 4 | 527.335 | 167.335 | 35.7 |
| 5 | 703.140 | 343.140 | 47.6 |
| 6 | 878.925 | 158.925 | 59.5 |
| 7 | 1054.711 | 334.711 | 71.4 |
| 8 | 1230.496 | 150.496 | 83.3 |
| 9 | 1406.281 | 326.281 | 95.2 |
| 10 | 1582.066 | 142.066 | 107.1 |
| 11 | 1757.851 | 317.851 | 119.0 |
| 12 | 1933.636 | 133.636 | 130.9 |
| 13 | 2109.421 | 309.421 | 142.8 |
| 14 | 2285.206 | 125.206 | 154.7 |
| 15 | 2460.991 | 300.991 | 166.6 |
| 16 | 2636.776 | 116.776 | 178.5 |
| 17 | 2812.562 | 292.562 | 190.4 |
| 18 | 2988.347 | 108.347 | 202.3 |
| 19 | 3164.132 | 284.132 | 214.2 |
| 20 | 3339.917 | 99.917 | 226.1 |
| 21 | 3515.702 | 275.702 | 238.0 |

In this embodiment, all axial positions are satisfied. All angular positions are not, and in addition, the angular positions are not in circumferential order, so detecting of sensors may be more difficult.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. An industrial roll, comprising:

a substantially cylindrical shell having an outer surface and an internal lumen;

a polymeric cover circumferentially overlying the shell outer surface, wherein the shell and cover include a plurality of through holes extending from an outer surface of the cover to the shell lumen, such that the lumen is in fluid communication with the environment external to the cover outer surface, the through holes being arranged in a repeating pattern of columns and rows, the columns of the repeating pattern defining an angle relative to a plane that is perpendicular to a longitudinal axis of the shell; and a sensing system comprising:

a plurality of sensors embedded in the cover, the sensors configured to sense an operating parameter of the roll; and a signal-carrying member serially connected with and extending between the plurality of sensors, the signal-carrying member following a helical path over the outer surface of the shell, wherein the signal carrying member extends over more than a full revolution of the shell outer surface, and wherein the helical path travels between columns of the repeating pattern substantially parallel to the angle formed by the columns of the repeating pattern.

2. The industrial roll defined in claim 1, wherein an intermediate segment of the signal-carrying member extends between adjacent sensors and extends over at least one complete revolution of the shell outer surface.

3. The industrial roll defined in claim 1, wherein the sensing system further comprises a processor operatively associated with the signal-carrying member that processes signals representative of the operating parameter conveyed thereby.

4. The industrial roll defined in claim 1, wherein the shell includes a helical groove that coincides with the helical path followed by the signal-carrying member, and wherein the signal-carrying member resides within the helical groove.

5. The industrial roll defined in claim 1, wherein the shell is formed of a metallic material.

6. The industrial roll defined in claim 1, further comprising at least one blind drilled hole located over one of the plurality of sensors.

7. The industrial roll defined in claim 1, wherein at least one of the plurality of sensors is configured to slide along and relative to the signal-carrying member.

8. The industrial roll defined in claim 1, further comprising a suction box positioned in the shell lumen.

9. The industrial roll defined in claim 1, wherein the signal-carrying member comprises an optical fiber.

10. An industrial roll, comprising:

a substantially cylindrical shell having an outer surface and an internal lumen;

a polymeric cover circumferentially overlying the shell outer surface, the cover including a preformed internal groove that follows a helical path, wherein the shell and cover include a plurality of through holes extending from an outer surface of the cover to the shell lumen, such that the lumen is in fluid communication with the environment external to the cover outer surface, the through holes being arranged in a repeating pattern of columns and rows, the columns of the repeating pattern defining an angle relative to a plane that is perpendicular to a longitudinal axis of the shell, and wherein the helical path travels between columns of the repeating pattern substantially parallel to the angle formed by the columns of the repeating pattern; and a sensing system comprising:

a plurality of sensors embedded in the cover, the sensors configured to sense an operating parameter of the roll; and a signal-carrying member serially connected with and extending between the plurality of sensors, the signal-carrying member residing in and following the helical path in the cover.

11. The industrial roll defined in claim 10, wherein the sensing system further comprises a processor operatively associated with the signal-carrying member that processes signals representative of the operating parameter conveyed thereby.

12. The industrial roll defined in claim 10, wherein the shell is formed of a metallic material.

13. The industrial roll defined in claim 10, further comprising at least one blind drilled hole located over one of the plurality of sensors.

14. The industrial roll defined in claim 10, wherein at least one of the plurality of sensors is configured to slide along and relative to the signal-carrying member.

15. The industrial roll defined in claim 10, further comprising a suction box positioned in the shell lumen.

16. The industrial roll defined in claim 10, wherein the cover comprises a base layer, and wherein the groove is located in an outer surface of the base layer.

17. The industrial roll defined in claim 10, wherein the signal-carrying member comprises an optical fiber.

18. An industrial roll, comprising:

a substantially cylindrical shell having an outer surface and an internal lumen;

a polymeric cover circumferentially overlying the shell outer surface, wherein the cover and shell include a plurality of through holes extending from an outer surface of the cover to the shell lumen, such that the lumen is in fluid communication with the environmental external to the cover outer surface, the through holes being arranged in a repeating pattern of columns and rows, the columns of the repeating pattern defining an angle relative to a plane that is perpendicular to a longitudinal axis of the shell; and a sensing system comprising:

a plurality of sensors embedded in the cover, the sensors configured to sense an operating parameter of the roll; and a signal-carrying member serially connected with and extending between the plurality of sensors, the signal-carrying member following a helical path over the outer surface of the shell;

wherein the cover further comprises at least one blind drilled hole located over one of the plurality of sensors; and wherein the helical path travels between columns of the repeating pattern substantially parallel to the angle formed by the columns of the repeating pattern.

19. The industrial roll defined in claim 18, wherein the sensing system further comprises a processor operatively associated with the signal-carrying member that processes signals representative of the operating parameter conveyed thereby.

20. The industrial roll defined in claim 18, wherein the shell is formed of a metallic material.

21. The industrial roll defined in claim 18, further comprising a suction box positioned in the shell lumen.

22. An industrial roll, comprising:

a substantially cylindrical shell having an outer surface and an internal lumen;

a polymeric cover circumferentially overlying the shell outer surface, wherein the shell and cover include a plurality of through holes extending from an outer surface of the cover to the shell lumen, such that the lumen is in fluid communication with the environment external to the cover outer surface, the through holes being arranged in a repeating pattern of columns and rows, the columns of the repeating pattern defining an angle relative to a plane that is perpendicular to a longitudinal axis of the shell; and a sensing system comprising:

a plurality of sensors embedded in the cover, the sensors configured to sense an operating parameter of the roll; and a signal-carrying member serially connected with and extending between the plurality of sensors, the signal-carrying member following a helical path over the outer surface of the shell, wherein the helical path travels between columns of the repeating pattern substantially parallel to the angle formed by the columns of the repeating pattern.

* * * * *